US008360432B2

(12) United States Patent
Hjerppe

(10) Patent No.: US 8,360,432 B2
(45) Date of Patent: Jan. 29, 2013

(54) THREE-DIMENSIONAL AND SPHERICAL SLIDING PUZZLE

(76) Inventor: Hannu Hjerppe, Fiskars (FI)

( * ) Notice: Subject to any disclaimer, the term of this patent is extended or adjusted under 35 U.S.C. 154(b) by 278 days.

(21) Appl. No.: 12/742,382

(22) PCT Filed: Nov. 26, 2008

(86) PCT No.: PCT/FI2008/000132

§ 371 (c)(1),
(2), (4) Date: May 11, 2010

(87) PCT Pub. No.: WO2009/068726

PCT Pub. Date: Jun. 4, 2009

(65) Prior Publication Data

US 2010/0264583 A1 Oct. 21, 2010

(30) Foreign Application Priority Data

Nov. 29, 2007 (FI) ..... 20070920

(51) Int. Cl.
*A63F 9/08* (2006.01)

(52) U.S. Cl. ..... 273/153 S

(58) Field of Classification Search ..... 273/153 S, 273/153 R

See application file for complete search history.

(56) References Cited

U.S. PATENT DOCUMENTS 4,452,454 A * 6/1984 Greene ..... 273/153 S
4,522,401 A * 6/1985 Gustafson ..... 273/153 S
4,889,340 A * 12/1989 Greene ..... 273/153 S
5,074,562 A * 12/1991 Green ..... 273/153 S
5,114,148 A * 5/1992 Liu ..... 273/153 S
5,452,895 A * 9/1995 Ray ..... 273/153 S
5,566,941 A * 10/1996 Destics ..... 273/153 S
5,836,584 A * 11/1998 Chen ..... 273/153 S
6,857,632 B2 * 2/2005 Tanner ..... 273/153 S
7,451,985 B2 * 11/2008 Giermek ..... 273/153 S
7,547,019 B2 * 6/2009 Chen ..... 273/153 S
2004/0065997 A1 4/2004 Tanner
2006/0226600 A1 * 10/2006 Fang et al. ..... 273/153 S

FOREIGN PATENT DOCUMENTS

DE 202005003754 U1 6/2005
WO 9427694 A1 12/1994

* cited by examiner

*Primary Examiner* — Steven Wong
(74) *Attorney, Agent, or Firm* — David A. Guerra

(57) ABSTRACT

Invention relates to a three-dimensional spherical sliding puzzle having a frame made of eight corner pieces, and seventeen square pieces each mobile in grooves bordering the corner pieces and along guide grooves defined in the corner pieces. The square pieces are moved independently, one at a time by one finger of a user while other the other square pieces are locked in place. The corner pieces are easily extrudable and can be assembled by the snap-connections-and are detached seamlessly with each other by symmetrical male-female-couplers. The grooves provided by the corner pieces of the ball frame have 18 points, where each of the 17 square pieces can be situated, whereby one free point is utilized for moving the pieces one at a time. The corner pieces each include retaining nails having a tip thickening located at an end thereof for releasably clamping to control buttons of the square pieces.

18 Claims, 6 Drawing Sheets

THREE-DIMENSIONAL AND SPHERICAL SLIDING PUZZLE

CROSS-REFERENCE TO RELATED APPLICATION

This application is an U.S. national phase application under 35 U.S.C. §371 based upon co-pending International Application No. PCT/FI2008/000132 filed on Nov. 26, 2008. Additionally, this U.S. national phase application claims the benefit of priority of co-pending International Application No. PCT/FI2008/000132 filed on Nov. 26, 2008 and Finland Application No. 20070920 filed on Nov. 29, 2007. The entire disclosures of the prior applications are incorporated herein by reference. The international application was published on Jun. 4, 2009 under Publication No. WO 2009/068726.

BACKGROUND OF THE INVENTION

1. Field of the Invention

The present invention relates to a three-dimensional, spherical sliding jigsaw puzzle. More precisely the present invention relates to a three-dimensional, spherical ball surface segment slide jigsaw.

2. Description of the Prior Art

In principle, the present invention is of a combination of a traditional two-dimensional slide-jigsaw and of a three-dimensional ball-jigsaw. (See the patents U.S. Pat. No. 4,889,340, GB245004).

The use of ball-jigsaws are known in the prior art and exist in the markets and the same that are known by the following trade names: RUBIK CUBE™; Pyraminx (tetrahedron); Ecuador (ball); IMPOSSIBALL™ (ball). Solutions relating to the field are disclosed in the following patents or in the patent applications: WO9427694 Three Dimensional Puzzle; U.S. Pat. No. 4,889,340 Spherical puzzle; U.S. Pat. No. 4,865,323 Spherical puzzle; U.S. Pat. No. 4,557,484 Three-dimensional sliding element puzzle; SU1388073 THREE-DIMENSIONAL PUZZLE; SU1391673, GAME/PUZZLE "SAIDOV'S BALL"; SU1719001 THREE-DIMENSIONAL LOGIC GAME; HU9602320 THREE DIMENSIONAL PUZZLE BASED ON THE MOVEMENT OF PIECES OF SURFACE SLIDING OR ROTATING ON A SPHERICAL SURFACE; MD980102 Tridimensional logic puzzle; DE3138050 Sliding sphere; WO2006089836 Ball-shaped puzzle.

In the existing 3D ball-jigsaws, where pieces are slided a whole ball circumference ("equator" or "meridian") at a time, it is difficult to control a movement of an individual piece, because one must have to rotate at the same the whole circumference along the guide groove which is in the ball, and to aim crossings of the circumferences at place, also on the ball's opposing half. Turning of the circumference takes place in these balls by means of a tight grip by one hand, while the other hand at the same tries to hold the ball "from the end" in other words from the calotte, respectively. For easing this weakness the triangular corners (8 Pcs) in many ball-models are concaved or shaped otherwise differently, whereby the surface has no longer a spherical design. The surface areas of the mobile pieces of these existing solutions are in addition relatively small, and the locked triangular corner-areas that are in the ball are on the other hand relatively large, in other words bad from a point of shuffling a surface figure. In addition, these are especially awkward to manufacture industrially as large series; there are several pieces to be manufactured and assembled separately, which pieces also have several areas to be printed.

SUMMARY OF THE INVENTION

One object of the present invention is to eliminate or at least essentially to reduce disadvantages of the known three-dimensional slide-jigsaws. A second object of the present invention is to provide a new and inventive ball surface segment slide-jigsaw both improved mechanics and function and dimensioning of the pieces of the slide-jigsaw such, that a largest possible area of the surface of the slide-jigsaw is a surface composed of surfaces of sliding pieces that are independently and easily movable by one finger.

In general, these objects can be achieved by the three-dimensional spherical ball surface segment slide-jigsaw, which comprises

- a frame, which is assembled of eight identical parts, corner pieces (03),
- square pieces (02), which are slidable in grooves existing between the frame parts, in which slide-jigsaw
- the square pieces remain fastened in the frame by means of locking organs or locking legs extending under the corner pieces in other words inside the frame, and
- the surfaces of the corner pieces and of the square pieces are concentric parts of the ball surface,
- the pieces move along the ball surface forming the three-dimensional spherical ball surface segment slide-jigsaw, the square pieces of which are mobile on the ball surface in the grooves bordered by the corner pieces on their guides, so that the square pieces exist 17 Pcs in other words one less than the guides can have, and moving of those take place independently one at a time by one finger, that a single piece is moved at a time other while the other pieces are locked in places, whereby the same are as part of guiding surfaces on an beginning and end parts of a motion distance of the piece to be moved, when the piece either releases from the locking or attaches thereto, for example thus, that at a crossing point of the guide grooves the locking of the square pieces is implemented by tip thickenings of the retaining nails, which are formed of corners of the corner piece or of the frame of the corner piece and which are in an angle of 45 degrees with respect to the guide grooves, and by grooves of the guiding extensions, which are under the corners of the square pieces.

In the present invention, there are 17 quadratic surface pieces, which move independently, (the 18th piece is missing, in other words the pieces are moved piece by piece by moving one piece by the measure of one piece). In the core (in the frame) of the ball there are guide grooves (a X-Y-Z grooves, in other words an equator, 0-meridian and 90-meridian), which divide the ball into eight symmetrical parts and there is a triangular fixed part of the ball surface in the middle of each part; corner. The concentric ball surfaces as combined with the X-Y-Z symmetry cause the fact that the quadratic surface pieces are (seemingly) freely mobile around the eight corners and there between. In other words between the eight fixed corners there is space corresponding the 18 quadratic pieces and the 17 pieces can be moved therein.

The dimensioning of the quadratic piece (corresponding ⅛ part of the ball's circumferential length) causes the fact that the piece can turn a sufficient number of times as moved around one corner piece back to its previous location but as turned 90 degrees around itself.

Then each piece can be located at anywhere of the 18 locations on the surface of the ball and the same can be therein in four different orientations. Correspondingly, during the turn around the corner described above, when one piece goes in the right way then the four other pieces, which are participating in the turning, will go wrong, this is an essential improvement from the point of surface pattering, so that there is no need to turn along all the pieces, which form the circuit, when there is a need to turn one piece. A bearing following the ball surface is exact and does not get stuck. Cf. a two-dimensional slide-jigsaw gets stuck easily. Essential is also a locking of the square pieces, in other words when one piece is moved the others are not able to move unintentionally and to hamper crossing traffic. The consequence is the degree of difficulty of the so-called RUBIK CUBE™ at its most difficult sense, if the pieces have both a location demand and an orientation demand (for example a pattern of the earth), whereas there is only a location demand in the version of color pieces, in other words the same is considerably easier to solve. In a version composed of gray tint pieces, the location is only with the accuracy of the zone (the Equator or the Tropic of Cancer or the Tropic of Capricorn).

One can mention about the advantages of the present invention generally out that, because of the improved mechanics and functions and dimensioning of the pieces of the slide-jigsaw, an easy usability and manufacturing of the slide-jigsaw is provided

BRIEF DESCRIPTION OF THE DRAWINGS

One advantageous embodiment according to the present invention is described in the following referring to the enclosed drawings, where.

DETAILED DESCRIPTION OF THE INVENTION

Figure 1:
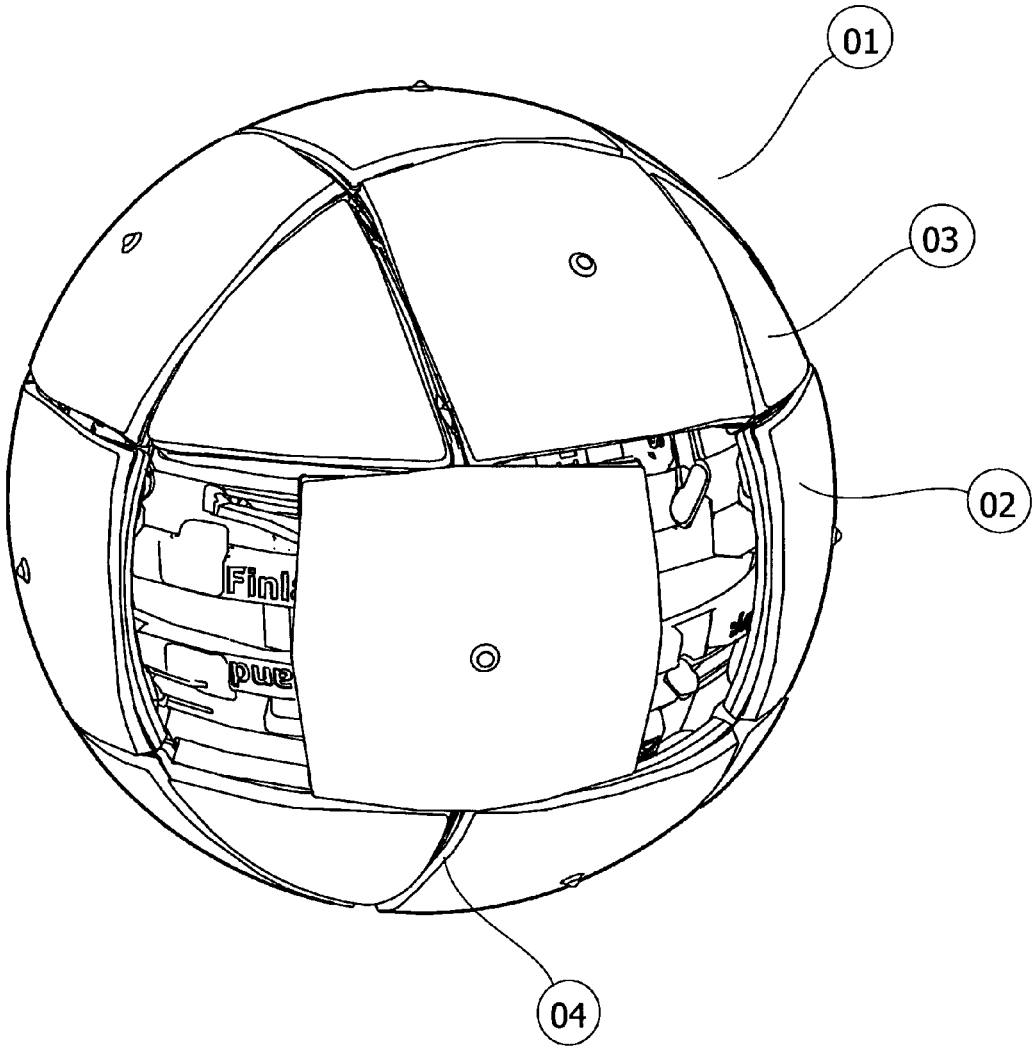
FIG. 1 presents an assembled ball when one piece moves.
Figure 2:
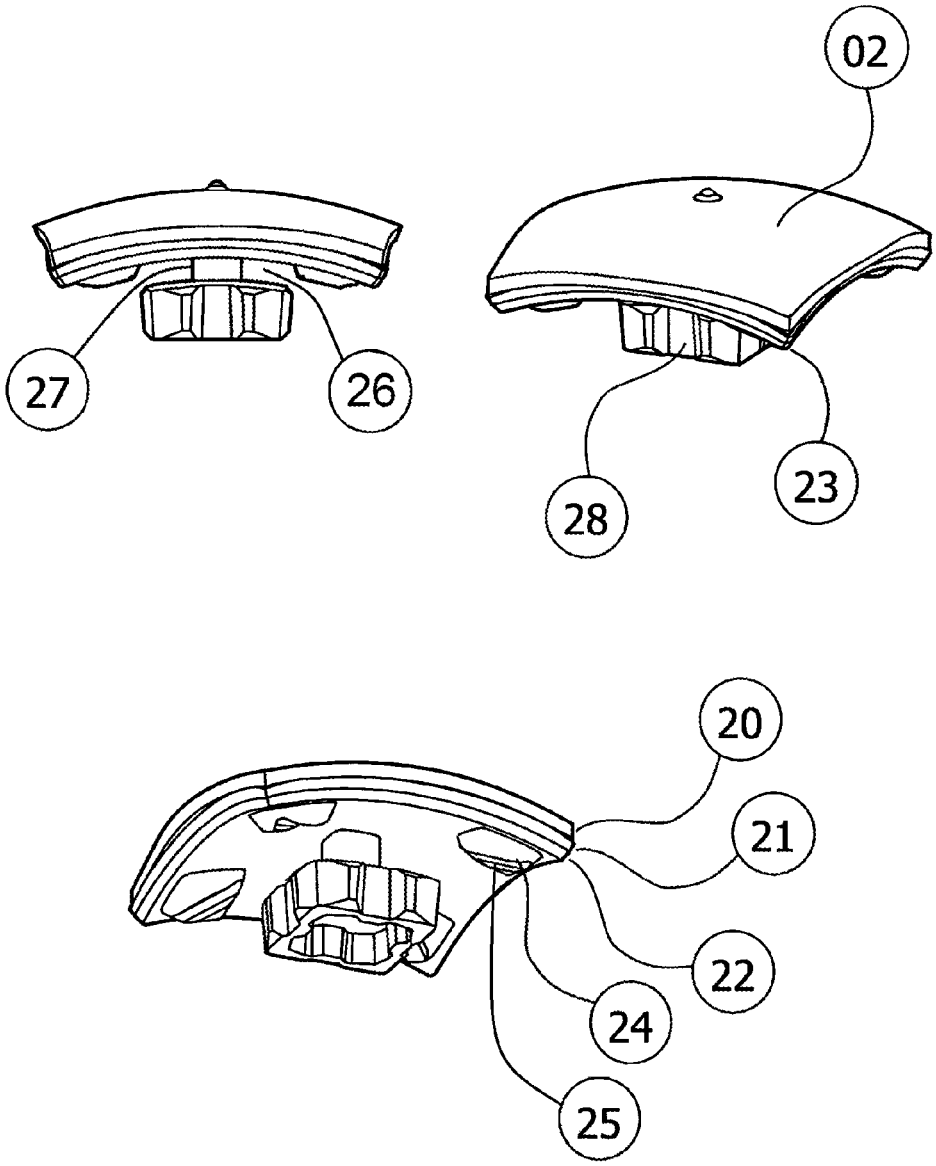
FIG. 2 presents a square piece more detailed with both as a perspective view and as a side projection view.
Figure 3:
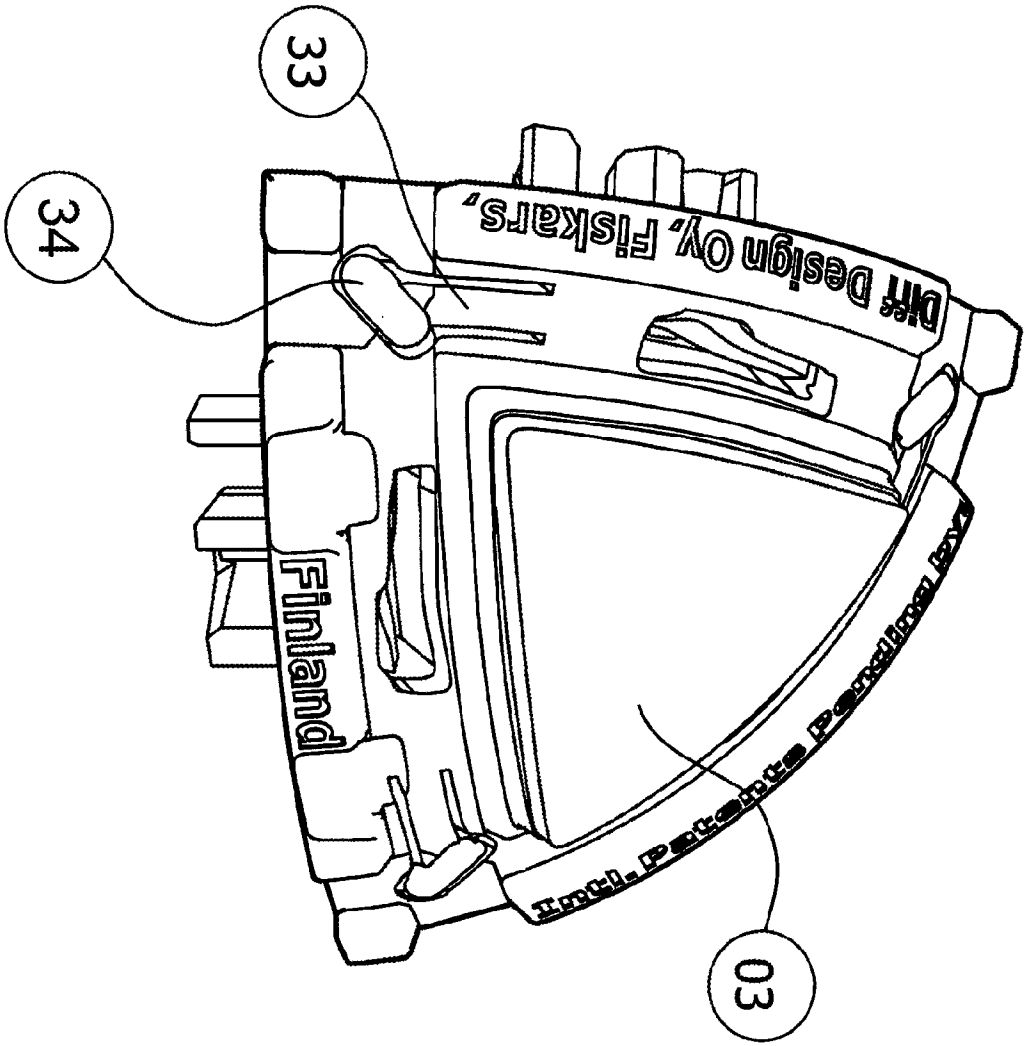
FIG. 3 presents a corner piece more detailed as a perspective view.
Figure 4:
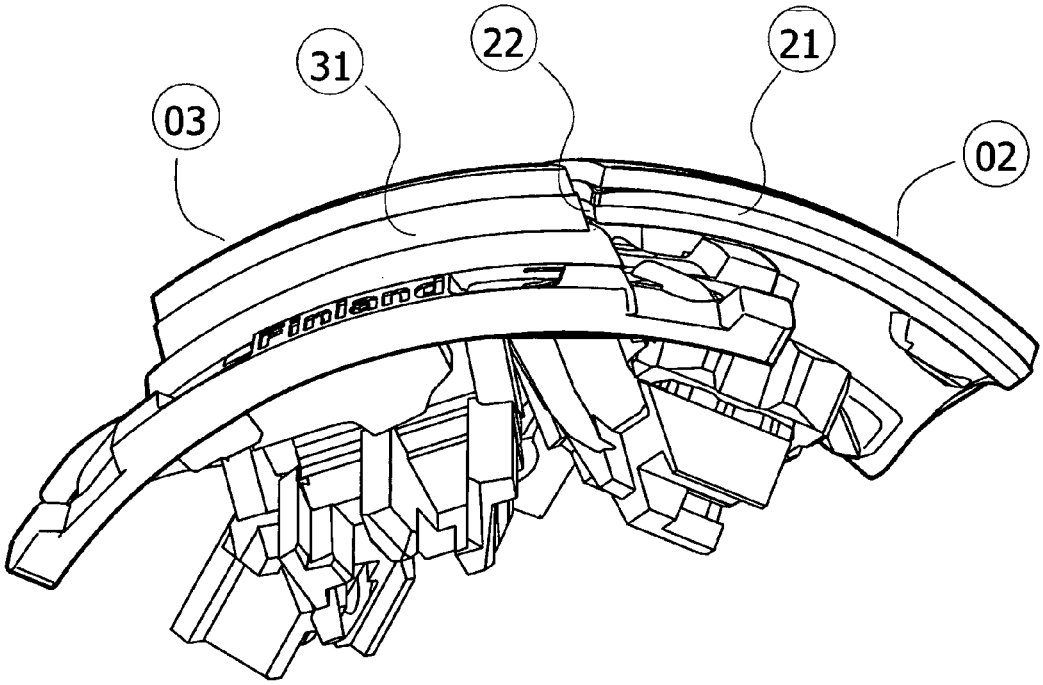
FIG. 4 presents control surfaces between the corner piece and the square piece in the operation, FIG. 6 present a contact between the corner pieces both bevels of the corners of the corner pieces and of the square pieces.
Figure 5:
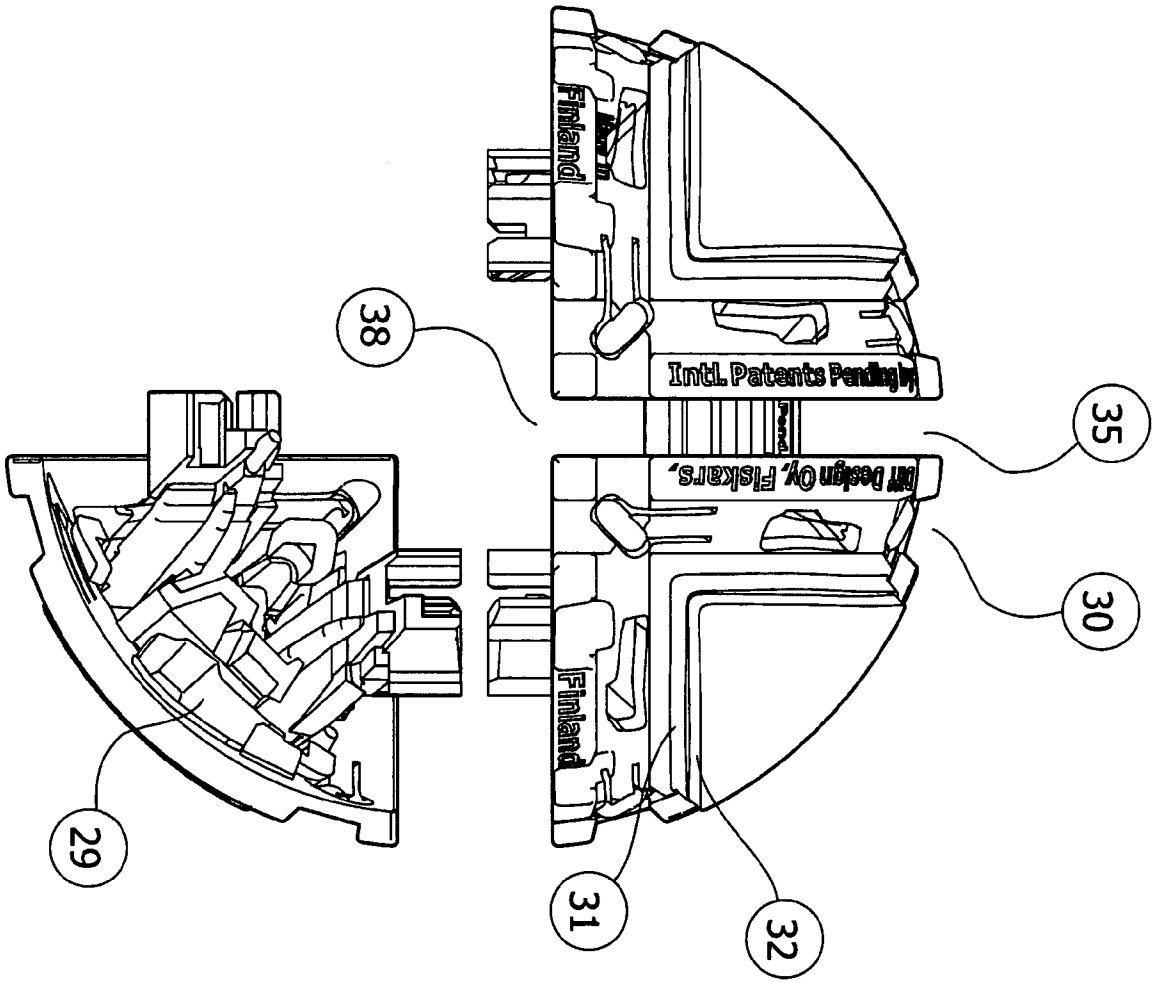
FIG. 5 presents two corner pieces as connected and a projection view from inside of one corner piece.

The design (edge, side) of both the corner pieces and square pieces 02, 03 has been divided into two layers, outer one 20, 32 of which helps to control the appearance, in other words the width of grooves 04 seen on the outer surface of the pieces, and the lower/inner layer 31 of said corner pieces serves as the control surface to the square piece 02. The-lower layer of the square pieces are two control surfaces 21, 22, from which the lower control surface 22 directs the square piece like on the rails 21 along the similar form 31 of the corner/triangle piece, and from which the upper control surface 21 is a contact surface and a control surface in the contacts between two square pieces (FIG. 6), in other words both when the square pieces meet face-to-face on the same groove and when the square piece, which is at the crossing location, when starting to move in a "transverse" direction, that is sideways, will stay in its locking in the control of the surrounding and stationary square pieces until the control transfers between the above mentioned lower control surface 22 and the control surface 31 of the respective corner piece.

So that the form of the point part of the corner piece will be letting and at the same time a full-time contact control is retained to the square pieces, a lower/inner layer of said square pieces is divided into the two surfaces 21, 22, which are at separate angles and which, together with the upper/outer control surface 20, have the letting forms that can be manufactured easily. The contact surface between the square pieces must be parallel with the radius of the ball and the same must have an area that is big enough so that the contact is preserved within a movement clearance and so that the pieces are not able to get overlapped on/under each other. The mere sharp corner/edge does not provide a necessary control/support. The grooves between the pieces are as narrow as possible in every location (between the square pieces both between the square piece and the corner piece) so that the outer surface of pieces of the ball will be as big as possible. When moving, the square piece will move quite touching the tip of the corner piece from its broadest place, in the middle of its movement, in which case the groove 04 in question gets momentarily closed.

The geometry of the control surfaces, in other words, the grooves cut to the corner pieces and correspondingly the dimensioning of the square pieces are based on an eighth of the circumference length of the ball, so that the above mentioned inner/lower layer and the lowest control surface have been cut with a 135-degree cone (minus a mould clearance of 2 degrees) that inside the ball, the tip of which cone is next to the centre of the ball a little. Correspondingly, the higher/outer appearance surface has been cut by a level, which goes via the centre of the ball and which has been turned 22.5 degrees, minus a suitable clearance, in regard to one axis. Whereby, when moving the upper/outer "layer" 20 of the square piece in the middle region of the square piece slides off above the inner/lower layer 31 of the corner piece, and correspondingly in the corners of the square piece the upper/outer appearance surface remains a little short. Whereby, the surface of the square piece remains a little short from its corners compared with the lower/inner layer and correspondingly the surface of the square piece curves from the middle region of the side over the lower/inner layer.

The consequence of the two-layered control geometry is the consistent appearance of the surface of the ball and the consequence of the one-eight division is a maximum area of the pieces to be mixed. Correspondingly, the fastening organs, legs 27, which connect the square pieces to the frame, are provided with beveled arm parts 28, in which case they seek into the groove 35 between the corner pieces after the piece has come loosened from its retaining nails 33.

Thanks to the lower control surface 22 of the edges of square pieces and thanks to the arms 28 of the legs 27 both thanks to the control buttons 24 of the lower surface 22 of the square piece is always in the control from at least three points that on separate lines, so the piece cannot be turned to get stuck when moving.

Structure of the ball, which is assembled from the frame's corner pieces 03 and from the square pieces 02 without outer fastening organs, enable to provide the square pieces, which are easily and lightly mobile by one finger, and which, when being locked, at the end of the movement distance thereof, to the retaining nails 33 of the frame composed of the corner pieces, form together with the two-layered control surface 31, 32 of the corner pieces the control surfaces for a movement of a following piece.

Figure 6:
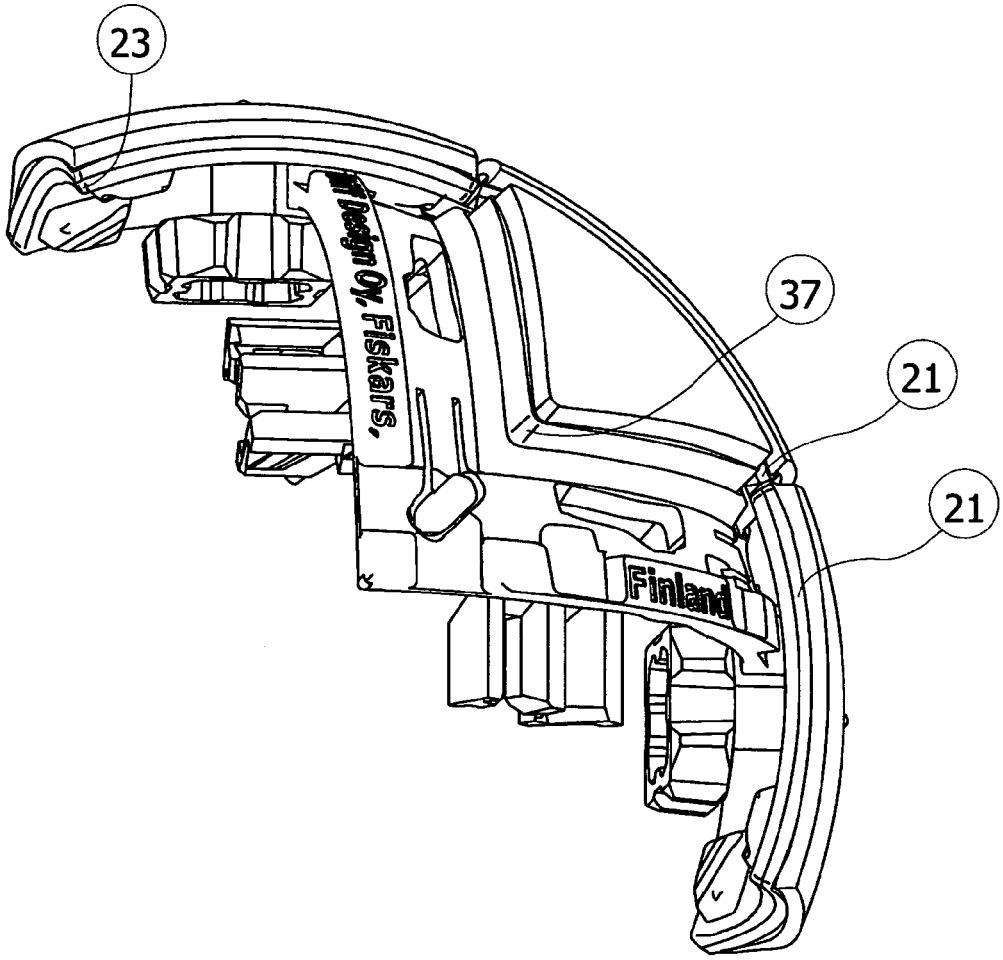

The square piece that is in its turn to be moved while being at the crossing point of the grooves 35, is surrounded from three sides by stationary square pieces and it is in the contact with the same from upper control surfaces 21 of the lower layer. When the above mentioned pieces are fast in their retaining, they function as control surfaces, at the beginning of the movement of the piece to be moved (FIGS. 1 and 6). The square pieces remain stationary by the legs 27 below, which legs extend enough inside the frame composed of the corner pieces 03, in other words "behind the corner". A rounded twin-tip bevel 23, which exists in the corners of the lower layer 21, 22 of the square pieces 02, directs the moving square piece pass its corner, when the square pieces are as locked around the crossing point 38 of the grooves 35. Nails or for example springs 29, which are on the corner pieces' lower surface 31, clamp into the cavities 26 of the legs 27 providing the retaining, when the square piece 02 in question is on a "straight" part of the groove 35 between corner pieces 03.

At the crossing point of the grooves, the retaining is implemented by tip thickenings 34 of the nails 33 of the corner piece on by corner piece frame and by the control buttons 24 that are under the corners of the square pieces. These bowelled control buttons direct the square piece in a desired direction along the guide grooves 30 in the corner pieces immediately after the corner piece has come loosened from its retaining nail and in the same from the control of the other square pieces. A twin-bevel 37 that receives the control buttons of the square pieces exists at the crossing point of the guide grooves.

The grooves 25 in control buttons 24, which clamp to nails of the corner piece, are in the angle of 45 degrees in regard to the guide grooves, in other words in regard movement directions of the piece, so that the retaining is on only when the piece is at the crossing point. When looking the crossing of the grooves in a vertical projection, the nails of the corner pieces and the grooves for the control buttons, which take hold of them, are in an angle of 45 degrees with respect to movement directions of the pieces and directed parallel to the radius of the center point of the crossing point, so that the square piece that is at the crossing point does not get to rotate in place. Correspondingly the legs 27, which connect the square pieces to the frame, have beveled arm parts 28, whereby they seek into the groove 35 between the corner pieces after the piece has come loose from its retaining nails. Thanks to the lower control surface 22 of the edges of the square pieces and thanks to arms 28 of the legs 27 and thanks to the guide extensions 24 on the lower surface the square piece is always under control from at least three points that are on different lines, and so the piece cannot turn around to become stuck while moving. On the movement track of the piece, a suitable clearance in regard to the frame of the ball in other words in regard to the corner pieces enable a very easy mobility between the retaining points of the piece, whereby the piece is got to move from its retaining and to glide towards the following retaining point by a push of just one finger.

By means of the retaining of the square pieces, in other words by the spring feature of the thin retaining nails, such a sound and a feeling that the piece in the right position and in place is achieved. It is especially important that the piece doesn't remain an amount of tenth millimeter stuck, at the crossing point, in other words "behind the corner", compare the RUBIK CUBE™.

The invention claimed is:

1. A three-dimensional spherical ball slide-jigsaw device comprising:

a frame comprising at least eight corner pieces, and grooves defined between said corner pieces, said corner pieces each comprising an outer surface, an inner surface, at least one retaining nail located at each corner of said inner surface, and guide grooves defined in said inner surface and bordering said outer surface, each of said retaining nails having a tip thickening located at an end thereof and at an angle of 45 degrees with respect to said guide grooves respectively; and at least seventeen square pieces each comprising an outer surface, an inner surface, a control button located at each corner of said inner surface, and a leg extending from said inner surface and slidably received in said grooves of said frame respectively, said leg including at least one arm extending under at least one of said inner surface of said corner pieces;

wherein said control buttons of said square pieces being configured to travel along said guide grooves of said corner pieces;

wherein said frame, said corner pieces and said square pieces are configured so that said square pieces are independently movable one at a time so that one of said square pieces is moved at a time while remaining said square pieces are locked in place respectively;

wherein said retaining nails of said corner pieces releasably clamp to said control buttons of said square pieces respectively.

2. The three-dimensional spherical ball slide-jigsaw device according to claim 1, wherein said inner surface of said square pieces is divided into two guiding surfaces, which are in two different angles and of which a lower of said two guiding surfaces guides said square piece along said inner surface of a corresponding said corner piece.

3. The three-dimensional spherical ball slide-jigsaw device according to claim 1, wherein said inner surface of said square piece is divided into two guiding surfaces, which are in two different angles and of which an upper of said guiding surfaces is a contact surface and a guiding surface for contacts between two of said square pieces.

4. The three-dimensional spherical ball slide-jigsaw device according to claim 3, wherein said contact surface of said square pieces is parallel with a radius of said three-dimensional spherical ball slide-jigsaw device, and has an area sufficient so that contact is preserved within a movement clearance and to prevent overlapping of said square pieces adjacent each other.

5. The three-dimensional spherical ball slide-jigsaw device according to claim 1, wherein said outer and inner surfaces of said corner pieces have a substantially triangular configuration.

6. The three-dimensional spherical ball slide-jigsaw device according to claim 1, wherein said control buttons of said square pieces each have a groove defined therein configured to receive said tip thickening of said retaining nails of said corner pieces respectively.

7. The three-dimensional spherical ball slide-jigsaw device according to claim 6, wherein locking of said square pieces at a crossing point of said grooves of said frame is implemented by said tip thickenings of the retaining nails.

8. The three-dimensional spherical ball slide-jigsaw device according to claim 7, wherein when viewing said crossing point of said grooves in a vertical projection, said retaining nails of said corner pieces and said grooves of said control buttons are in an angle of 45 degrees with respect to movement directions of said square pieces and directed parallel to a radius of a center point of said crossing point, so that said square piece that is at said crossing point is retained in place.

9. The three-dimensional spherical ball slide-jigsaw device according to claim 1, wherein said retaining nails of said corner pieces are biased members attached to said inner surface at one end of said retaining nails respectively.

10. The three-dimensional spherical ball slide-jigsaw device according to claim 1, wherein said corner pieces further comprising male and female couplers, and said corner pieces are detachable from each other by said male and female couplers.

11. The three-dimensional spherical ball slide-jigsaw device according to claim 7, wherein said lower surface of said square pieces each further comprising a beveled corner, said beveled corner being configured to direct said square pieces pass said corner pieces when said square pieces are locked around said crossing point.

12. The three-dimensional spherical ball slide-jigsaw device according to claim 7, wherein said lower surface of said corner pieces each further comprising at least one spring configured so as to be received into at least one cavity defined between said arm of said leg and said lower surface of said square pieces.

13. The three-dimensional spherical ball slide-jigsaw device according to claim 1, wherein a configuration of said grooves of said corner pieces and dimensions of said square pieces are based on an eighth of a circumference length of said three-dimensional spherical ball slide-jigsaw device.

14. A spherical sliding puzzle comprising:

a plurality of corner pieces each comprising an outer surface, an inner surface, at least one retaining nail located at each corner of said inner surface, and guide grooves defined in said inner surface and bordering said outer surface, each of said corner pieces further comprising couplers configured to releasable connect adjacent corner pieces to each other to form a frame, said inner surface of said corner pieces each being configured to define a groove between said corner pieces adjacent to each other; and a plurality of square pieces each comprising an outer surface, an inner surface, a control button located at each corner of said inner surface, and a leg extending from said inner surface and slidably received in said grooves of said frame respectively, said leg including at least one arm extending under at least one of said inner surface of said corner pieces;

wherein said control buttons of said square pieces being configured to travel along said guide grooves of said corner pieces;

wherein said corner pieces and said square pieces are configured so that said square pieces are independently movable one at a time so that one of said square pieces is moved at a time while remaining said square pieces are locked in place respectively;

wherein each of said retaining nails of said corner pieces is a spring member having one end connected to said inner surface of said corner piece so as to releasably clamp to said control buttons of said square pieces respectively.

15. The spherical sliding puzzle according to claim 14, wherein each of said retaining nails has a tip thickening located at an end opposite of said end connected to said inner surface of said corner pieces, said tip thickening being orientated at an angle of 45 degrees with respect to said guide grooves respectively.

16. The spherical sliding puzzle according to claim 14, wherein said inner surface of said square pieces is divided into an upper guiding surface and a lower guiding surface, said upper guiding surface is orientated at an angle different that of said lower guiding surface, said lower guiding surface guides said square piece along said inner surface of a corresponding said corner piece, said upper guiding surface is a contact and guiding surface for contacts between two of said square pieces.

17. The spherical sliding puzzle according to claim 14, wherein said control buttons of said square pieces each have a groove defined therein configured to receive said tip thickening of said retaining nails of said corner pieces respectively to releasably lock said square pieces at a crossing point of said grooves of said frame.

18. The spherical sliding puzzle according to claim 14, wherein when viewing said crossing point of said grooves in a vertical projection, said retaining nails of said corner pieces and said grooves of said control buttons are in an angle of 45 degrees with respect to movement directions of said square pieces and directed parallel to a radius of a center point of said crossing point, so that said square piece that is at said crossing point is retained in place.

* * * * *